US011083663B1

(12) United States Patent
Mullins

(10) Patent No.: US 11,083,663 B1
(45) Date of Patent: Aug. 10, 2021

(54) CERVICAL TRACTION DEVICE

(71) Applicant: Stephen Mullins, Monroe, GA (US)

(72) Inventor: Stephen Mullins, Monroe, GA (US)

( * ) Notice: Subject to any disclaimer, the term of this patent is extended or adjusted under 35 U.S.C. 154(b) by 0 days.

(21) Appl. No.: 16/787,664

(22) Filed: Feb. 11, 2020

(51) Int. Cl.
*A61H 1/02* (2006.01)
*A61G 13/12* (2006.01)

(52) U.S. Cl.
CPC ..... *A61H 1/0296* (2013.01); *A61G 13/121* (2013.01); *A61G 13/126* (2013.01); *A61H 2205/04* (2013.01)

(58) Field of Classification Search
CPC ..... A61G 13/009; A61H 1/00; A61H 1/006; A61H 1/008; A61H 1/02; A61H 1/0218; A61H 1/0222; A61H 1/0292; A61H 1/0296; A61H 2001/0203; A61H 2001/0207; A61H 2203/0456; A61H 2201/1604; A61F 5/055; A61F 5/3707
USPC ..... 606/237, 240, 241
See application file for complete search history.

(56) References Cited

U.S. PATENT DOCUMENTS 2,633,125 A * 3/1953 Yellin ..... A61F 5/04 602/36
2,907,324 A * 10/1959 Catanzaro ..... A61H 1/0222 606/242
4,166,459 A * 9/1979 Nightingale ..... A61H 1/0218 5/636
4,204,529 A * 5/1980 Cochrane ..... A61F 5/3707 602/19
4,407,274 A * 10/1983 Goodley ..... A61H 1/0218 606/241
4,489,713 A * 12/1984 Latenser ..... A61H 1/0292 5/624
4,538,598 A * 9/1985 Gill ..... A61H 1/0218 602/33
4,546,766 A * 10/1985 Hill ..... A61H 1/0222 188/71.8

(Continued)

FOREIGN PATENT DOCUMENTS

CN 207545286 U * 6/2018
RU 2548507 C1 * 4/2015

OTHER PUBLICATIONS

Half Moon/Half Cylinder Neck Roll Pillow, Jun. 5, 2016. (Year: 2016).*

*Primary Examiner* — Justine R Yu
*Assistant Examiner* — Benjamin M. Kusiak
(74) *Attorney, Agent, or Firm* — F. Wayne Thompson, Jr.; Asgaard Patent Services, LLC

(57) ABSTRACT

An example cervical traction device includes a traction assembly configured to cyclically apply a traction force to a patient's cervical spine at an angle to the longitudinal axis of the cervical spine to bend the cervical spine. The traction assembly is made up of an electric motor operably connected to a headgear by a traction line capable of transferring traction force generated by the electric motor to the headgear. The electric motor is operably connected to the traction line by a linkage and a linear actuator rod. Together, the linkage and the linear actuator rod are configured to convert torque generated by the electric motor into back-and-forth linear motion used to cyclically apply traction force to the traction line and thereby the headgear. The linear actuator rod is supported by two posts, each of the two posts includes an eyelet through which the linear actuator rod reciprocates.

14 Claims, 3 Drawing Sheets

(56) References Cited

U.S. PATENT DOCUMENTS 4,869,240 A * 9/1989 Boren ..... A61H 1/0229 602/32
4,986,261 A * 1/1991 Iams ..... A61H 1/0218 482/51
5,074,287 A * 12/1991 Avitt ..... A61H 1/0218 128/845
5,147,287 A * 9/1992 Jewell ..... A61G 13/12 5/622
5,382,226 A * 1/1995 Graham ..... A61H 1/0218 128/845
5,409,452 A 4/1995 Aversano
5,601,527 A * 2/1997 Selkowitz ..... A61H 3/008 254/413
5,865,780 A * 2/1999 Tuite ..... A61F 5/055 128/870
5,957,876 A * 9/1999 D'Amico ..... A61H 1/0218 602/33
6,113,563 A * 9/2000 D'Amico ..... A61H 1/0218 602/32
6,190,345 B1 * 2/2001 Henderson ..... A61H 1/0218 602/32
6,258,050 B1 * 7/2001 Henderson ..... A61H 1/0218 602/32
7,601,132 B2 10/2009 Nichols et al.
2007/0106192 A1 * 5/2007 Johnson ..... A61H 1/0222 602/32
2007/0293796 A1 * 12/2007 Graham ..... A61G 13/009 602/19
2009/0209895 A1 * 8/2009 Tornatore ..... A61H 1/0229 602/34
2009/0306567 A1 * 12/2009 Meyer ..... A61H 1/0292 602/33
2013/0269710 A1 * 10/2013 Hight ..... A61G 13/06 128/845
2015/0290072 A1 10/2015 Singhal
2015/0313785 A1 * 11/2015 Shamas ..... A61H 1/0296 602/36
2017/0246021 A1 * 8/2017 Jaeger ..... A61H 1/0222
2018/0008315 A1 * 1/2018 Currier ..... A61B 17/6433
2018/0214333 A1 * 8/2018 McKenney ..... A61F 5/048
2020/0069503 A1 * 3/2020 Zhou ..... A61H 1/00

* cited by examiner

CERVICAL TRACTION DEVICE

TECHNICAL FIELD

This disclosure relates to implementations of a cervical traction device. In particular, the present invention is primarily directed to a traction device that can be used to correct abnormal curvature in the cervical spine.

BACKGROUND

Cervical lordosis is the normal inward lordotic curvature of the cervical region of the human spine. The cervical region, also referred to as the cervical spine, includes the upper seven vertebrae of the spine. A loss of cervical lordosis has can cause spinal deformity, neurologic deficits, and chronic pain.

Chiropractors are often sought out to treat mechanical disorders of the musculoskeletal system, including the cervical spine. Chiropractic treatment involves spinal manipulation which is used to improve joint motion and function, this in turn improves overall spinal function and general health. While manual manipulation of the cervical spine has been shown to offer symptomatic relief to patients, manual manipulation in and of itself has not been shown to permanently correct abnormal spinal structure.

Alternatively, cervical traction can be used to manipulate the spine and thereby treat mechanical disorders of the musculoskeletal system (e.g., abnormal curvature in the cervical spine). Cervical traction applied over a long period of time (e.g., 15-20 minutes) has been shown to consistently correct abnormal spinal curves.

Accordingly, it can be seen that needs exist for the cervical traction device disclosed herein. It is to the provision of a cervical traction device that is configured to address these needs, and others, that the present invention is primarily directed.

SUMMARY OF THE INVENTION

Implementations of a cervical traction device are provided. The cervical traction device is configured to apply a traction force to a patient's cervical spine during a therapy session. As a result, lordosis in the patient's cervical spine can be restored. Restored cervical lordosis should improve the morphology of herniated cervical discs and provide relief from cervical radiculopathy.

In a preferred implementation, the cervical traction device comprises:

a traction assembly configured to cyclically apply a traction force to the cervical spine at an angle to the longitudinal axis of the cervical spine to bend the cervical spine, the traction assembly comprises an electric motor operably connected to a headgear by a traction line, the traction line is capable of transferring traction force generated by the electric motor to the headgear, the electric motor is operably connected to the traction line by a linkage and a linear actuator rod, together the linkage and the linear actuator rod are configured to convert torque generated by the electric motor into back-and-forth linear motion used to cyclically apply traction force to the traction line and thereby the headgear, the linear actuator rod is supported by two posts, each of the two posts includes an eyelet through which the linear actuator rod reciprocates; and a curved orthosis adapted to rest directly on the surface of the therapy table and for being positioned under the cervical spine of the patient during treatment;

wherein the traction assembly is configured to bend the cervical spine about the curved orthosis while exerting the traction force.

In general, the cervical traction device works by cyclically applying a traction force that pulls at an angle to the longitudinal axis of the spine to bend the cervical spine about the curved orthosis and thereby stretch the soft tissues.

The cervical traction device is designed to be used with a patient resting on a therapy table in the supine position. The supine position permits relaxation of the neck muscles, thereby increasing the effectiveness of the cervical traction. The curved orthosis is adapted to rest on the therapy table while positioned under the cervical spine of the patient.

During a cervical traction session, the traction force is exerted, then released, over a prescribed period of time and alternates between a first traction force and a second lower traction force or between a traction force and no-traction force. This cyclical application of traction to the cervical spine reduces the occurrence of neck spasms. The curved orthosis positioned under the cervical spine of the patient is shaped to induce and maintain cervical lordosis while the traction force is being exerted.

In some implementations, the traction line includes a spring adapted to graduate traction force being applied to the patient's cervical spine by the headgear during a therapy session.

BRIEF DESCRIPTION OF THE DRAWINGS

Like reference numerals refer to corresponding parts throughout the several views of the drawings.

DETAILED DESCRIPTION

Figure 1:
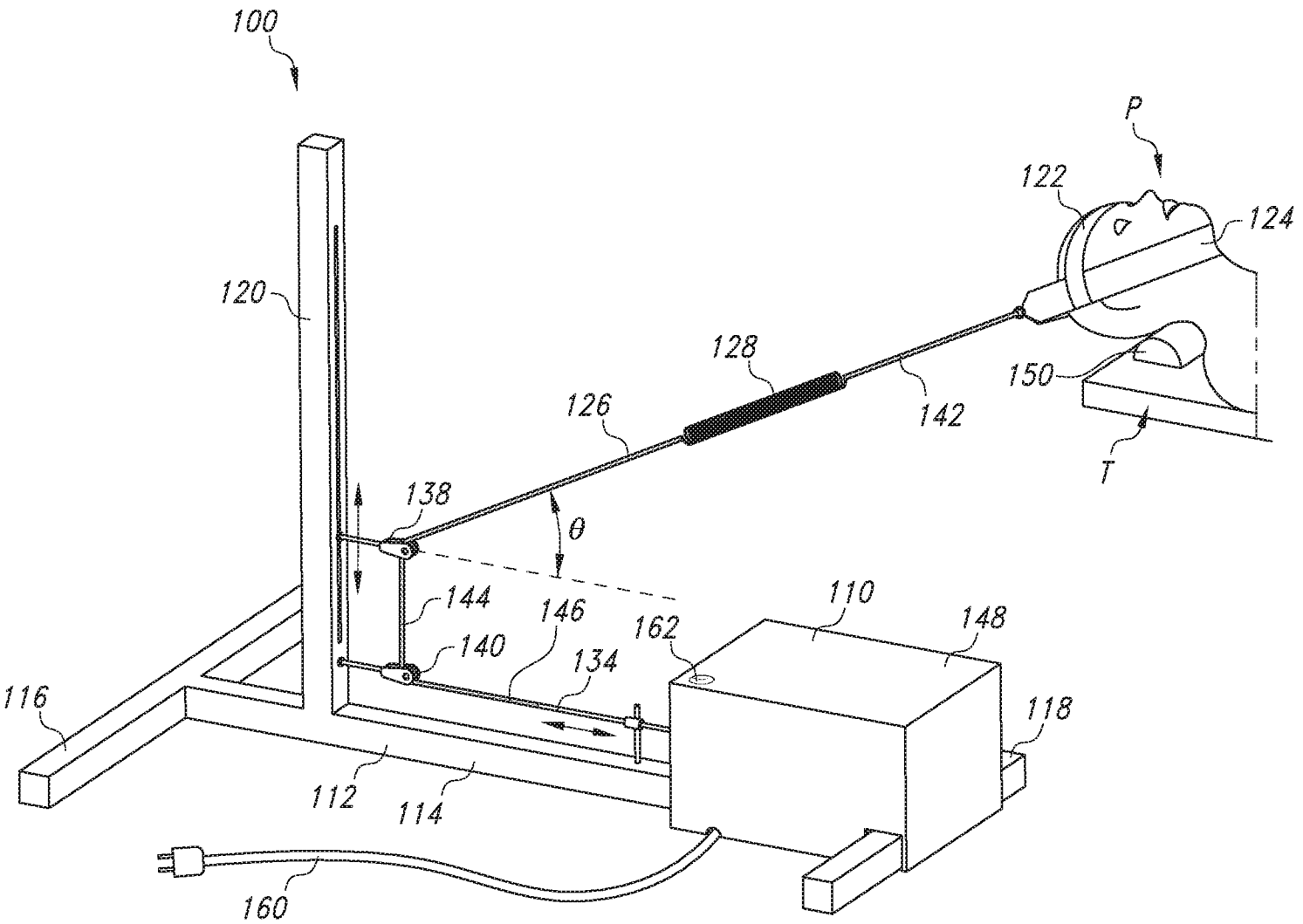
FIGS. 1 and 2 illustrate an example cervical traction device according to the principles of the present disclosure; the cervical traction device is shown being used to apply a traction force to the cervical spine of a patient (P) resting in the supine position on a therapy table (T).
Figure 2:
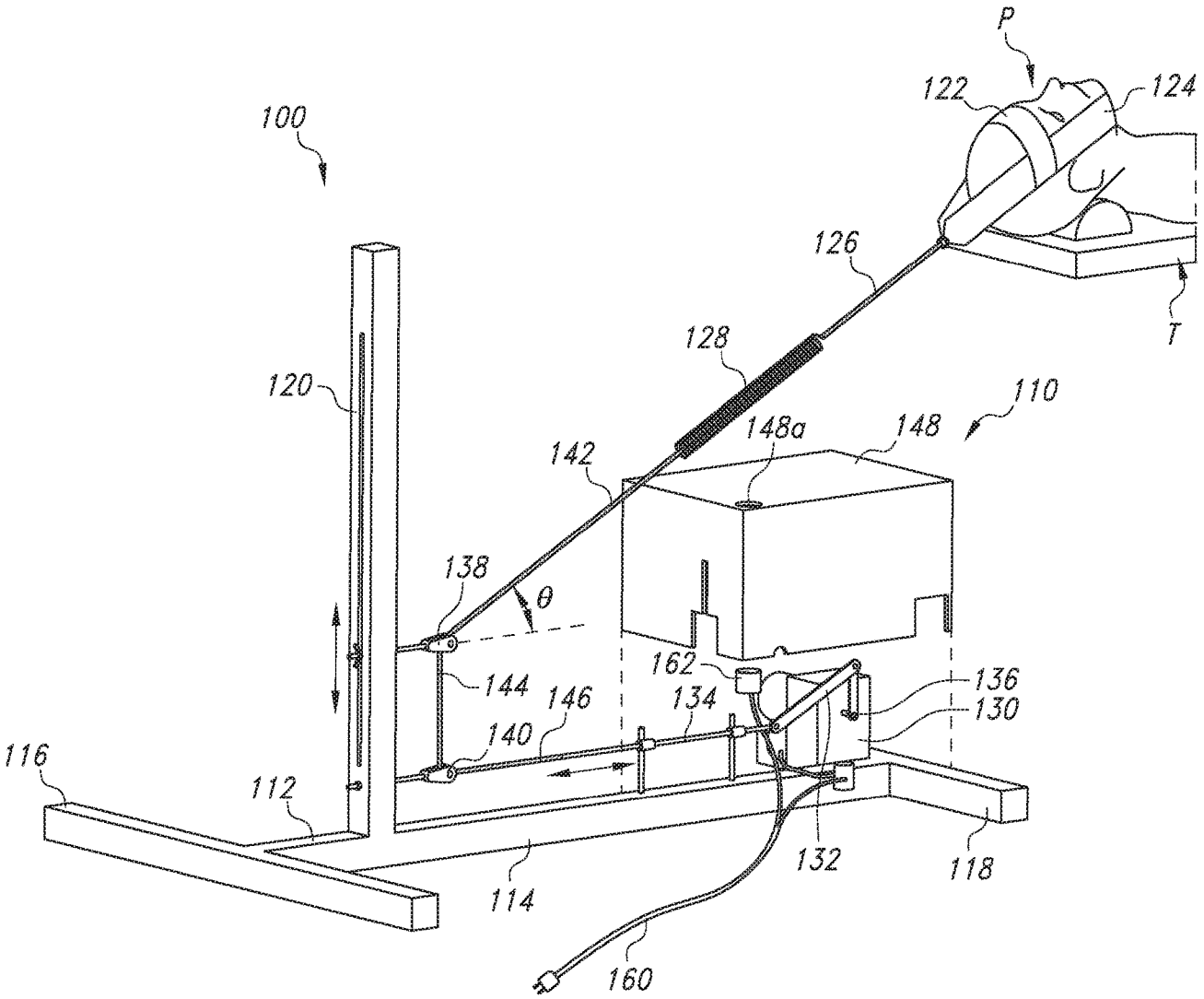

FIGS. 1 and 2 illustrate an example cervical traction device 100 according to the principles of the present disclosure. The cervical traction device 100 is configured to cyclically apply a traction force to a patient's cervical spine during a therapy session. As a result, lordosis in the patient's cervical spine can be restored. Restored cervical lordosis should improve the morphology of herniated cervical discs and provide relief from cervical radiculopathy.

As shown in FIGS. 1 and 2, in a preferred implementation, the cervical traction device 100 comprises: a traction assembly 110 configured to cyclically apply a traction force to the cervical spine at an angle to the longitudinal axis of the cervical spine to bend the cervical spine; and a curved orthosis 150 adapted for being positioned under the cervical spine of the patient during treatment. The traction assembly 110 is configured to bend the cervical spine about the curved orthosis 150 while exerting the traction force. In this way, cervical lordosis can be restored to the patient's spine.

In general, the cervical traction device 100 works by cyclically applying a traction force that pulls at an angle to the longitudinal axis of the spine to bend the cervical spine about the curved orthosis 150 and thereby stretch the soft tissues. This is generally referred to as cervical extension traction. It should be noted that, maintenance of the cervical lordotic curve during cervical traction appears to improve treatment outcomes for patients with cervical spine disorders. The traction force is applied using a headgear 122, having a chin strap 124, that is pulled rearwardly and downwardly by a dynamic traction line 126 (see, e.g., FIGS. 1 and 2). The traction line 126 is "dynamic" because the included spring 128 allows it to stretch, thereby graduating any traction force applied to the cervical spine during a therapy session.

During a cervical traction session, the traction force is exerted, then released, over a prescribed period of time and alternates between a first traction force and a second lower traction force or between a traction force and no-traction force. This cyclical application of traction to the cervical spine reduces the occurrence of neck spasms. Also, it has been shown that the cyclical application of traction to the cervical spine may aid in the rehydration of the cervical discs. It is believed that the pumping action induced by the cyclical application of traction draws water to the cervical disc that is then absorbed. The curved orthosis 150 positioned under the cervical spine of the patient induces and maintains cervical lordosis while the traction force is being exerted.

As an example, the cervical traction device 100 may be configured to progressively apply, then release, a peak traction force of 50 newtons (or substantially 11 lbs.) to the cervical spine every six second until the cervical traction session has been completed, or otherwise ended. Typically, a cervical traction session last 15 to 20 minutes. 50 newtons is an effective peak traction force for use during treatment, but it is contemplated that some patients may benefit from a traction force that is less than, or greater than, 50 newtons. As such, it should be understood that the cervical traction device 100 can be configured to provide a peak traction force that is greater than, or less than, 50 newtons.

As shown in FIGS. 1 and 2, the cervical traction device 100 is designed to be used with a patient (P) resting on a therapy table (T) in the supine position. The supine position permits relaxation of the neck muscles, thereby increasing the effectiveness of the cervical traction. The curved orthosis 150 is adapted to rest on the therapy table (T) while positioned under the cervical spine of the patient (P).

As shown in FIGS. 1 and 2, the cervical traction device 100 includes a frame 112 that supports all other portions of the cervical traction device 100, with the exception of the curved orthosis 150. The frame 112 includes a generally I-shaped base having a fore-and-aft extending longitudinal member 114 and a pair of transversely extending cross members 116, 118 at opposite ends thereof. The frame 112 also includes an upright mast 120 having a rectangular cross-section.

As shown in FIGS. 1 and 2, the traction assembly 110 comprises an electric motor 130 operably connected to the headgear 122 by the traction line 126. The traction line 126 is capable of transferring traction force generated by the electric motor 130 to the headgear 122. In some implementations, the electric motor 130 is operably connected to the traction line 126 by a linkage 132 and a linear actuator rod 134. Together, the linkage 132 and the linear actuator rod 134 are configured to convert torque generated by the electric motor 130 into back-and-forth linear motion used to cyclically apply traction force to the traction line 126. More specifically, the linkage 132 includes a first end connected to a rotating shaft 136 of the electric motor 130 and a second end connected to the linear actuator rod 134. The linkage 132, powered by the electric motor 130, causes the linear actuator rod 134 to reciprocate (i.e., move back-and-forth). In the preferred implementation of the invention, the linear actuator rod 134 has a 4" range of motion.

FIG. 2 illustrates the electrical motor 130 with its cover 148 removed. The electrical motor 130 includes a power cord 160 and a timer switch 162, both of which are well known to those of ordinary skill in the art. The power cord 160 is configured to transfer electricity from a wall outlet to the electrical motor 130 of the cervical traction device 100. The timer switch 162 is configured to turn the electrical motor 130 ON and, after a preset time has elapsed, OFF. In some implementations, a simple ON/OFF switch could be used instead of the timer switch 162. In some implementations, the timer switch 162 is positioned within an opening **148*a* in the cover 148 of the electrical motor 130**.

As shown in FIGS. 1 and 2, the cervical traction device 100 includes two pulley devices 138, 140 connected to the upright mast 120 of the frame 112. The traction line 126 passes through each pulley device 138, 140 and is moveable relative thereto. Together, the pulley devices 138, 140 are configured to assist with maintaining tension in the traction line 126. In this way, the pulley devices 138, 140 assist the traction line 126 with the transfer of traction force to the headgear 122. The first pulley device 138 is configured to be adjustably positioned on the upright mast 120 of the frame 112 and the second pulley device 140 is fixed in position on the upright mast 120.

As shown in FIGS. 1 and 2, the traction line 126 passes through the first pulley device 138 in a manner such that the traction line 126 defines a first length 142 extending between the first pulley device 138 and the headgear 112. The first length 142 of the traction line 126 is at an angle relative to the floor. The traction line 126 then passes through the second pulley device 140 in a manner such that the traction line 126 defines a second length 144 extending between the first pulley device 138 and the second pulley device 140. The second length 144 of the traction line 126 is essentially perpendicular to the floor. The traction line 126 also includes a third length 146 that extends between the second pulley device 140 and the linear actuator rod 134. The third length 146 is essentially parallel to the floor.

In general, the height adjustable pulley device 138 is used to set the angle of the traction line's 126 first length 142 at 45°, or less, relative to the floor. Or, stated another way, the height adjustable pulley device 136 can be used to hold the first length 142 of the traction line 126 at an angle between 0° and 45°, inclusive, from horizontal.

The traction line 126 is a rope or cord that includes a spring 128. More specifically, the spring 128 is included in the first length 142 of the traction line 126 (see, e.g., FIG. 1). The spring 128 is adapted to graduate traction force being applied to the patient via the headgear 112. Graduating the traction force being applied to the cervical spine reduces the occurrence of neck spasms. In some implementations, the spring 128 is a tension coil spring. One of ordinary skill in the art having the benefit of the present disclosure could select an appropriate spring 128 for use as part of the traction line 126.

As shown in FIGS. 1 and 2, the headgear 122 is adapted to be worn by the person being treated and is operably coupled to the rest of the traction assembly 110 by the traction line 126. The illustrated headgear 122 is an exemplary implementation, but it should be understood that other headgear suitable for applying a traction force to the cervical spine could be used without departing from the scope of the present invention.

Figure 3:
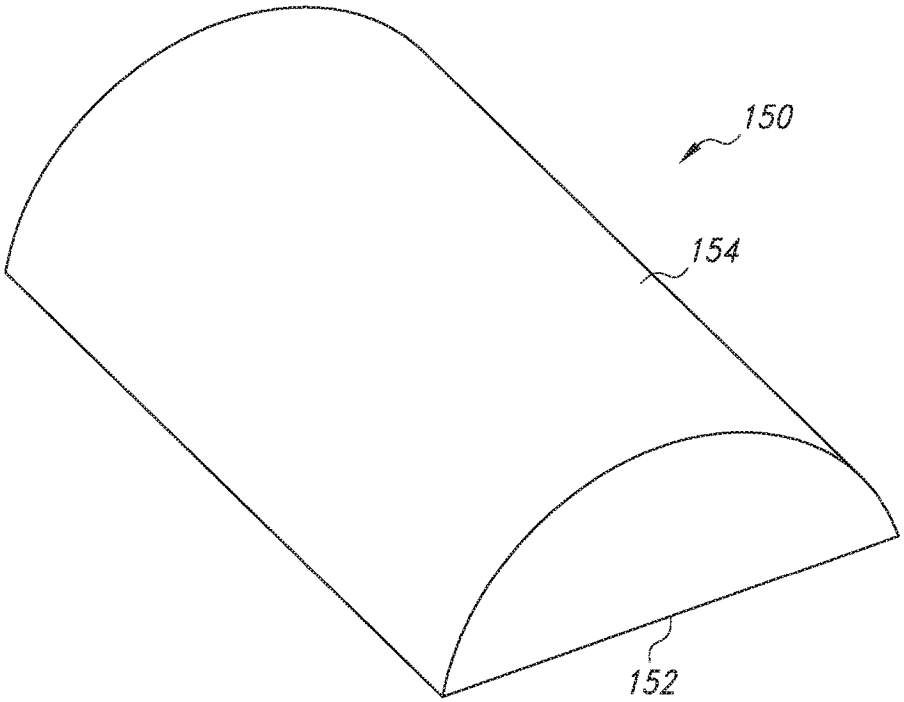
FIGS. 3 and 4 illustrate an example orthosis according to the principles of the present disclosure.
Figure 4:
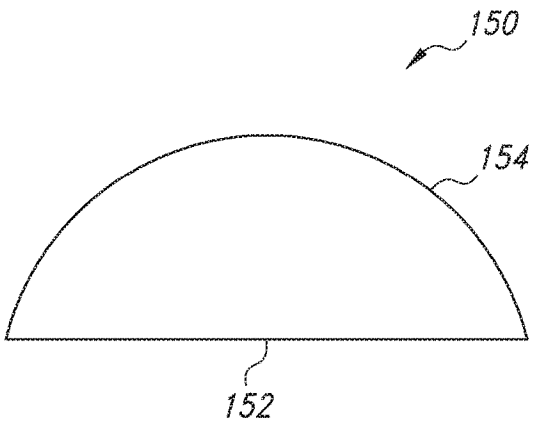

As shown in FIGS. 1 and 2, the curved orthosis 150 is adapted for being positioned on a therapy table (T) underneath the cervical spine of the patient (P). The curved orthosis has a flat base 152 and a curved exterior 154 shaped to induce and maintain cervical lordosis while traction is being applied to the cervical spine of the patient (see, e.g., FIGS. 1-4). In some implementations, as shown in FIGS. 3 and 4, the curved orthosis 150 has the general shape of an elliptical semicylinder (i.e., half of an elliptical cylinder cut longitudinally). However, it should be understood that other curved shapes capable of inducing and maintaining cervical lordosis while traction is being applied to the cervical spine of the patient at a downward angle could be used. The curved orthosis 150 is fabricated from polyethylene foam, but other suitable materials known to those of ordinary skill in the art could be used.

Although not shown in the drawings, the cervical traction device 100 could be configured to include a remote kill switch that is operably connected to the electric motor 130. Such a kill switch could be held by the patient during a therapy session and used to stop treatment for any reason.

Reference throughout this specification to "an embodiment" or "implementation" or words of similar import means that a particular described feature, structure, or characteristic is included in at least one embodiment of the present invention. Thus, the phrase "in some implementations" or a phrase of similar import in various places throughout this specification does not necessarily refer to the same embodiment.

Many modifications and other embodiments of the inventions set forth herein will come to mind to one skilled in the art to which these inventions pertain having the benefit of the teachings presented in the foregoing descriptions and the associated drawings.

The described features, structures, or characteristics may be combined in any suitable manner in one or more embodiments. In the above description, numerous specific details are provided for a thorough understanding of embodiments of the invention. One skilled in the relevant art will recognize, however, that embodiments of the invention can be practiced without one or more of the specific details, or with other methods, components, materials, etc. In other instances, well-known structures, materials, or operations may not be shown or described in detail.

While operations are depicted in the drawings in a particular order, this should not be understood as requiring that such operations be performed in the particular order shown or in sequential order, or that all illustrated operations be performed, to achieve desirable results.

The invention claimed is:

1. A cervical traction device used to correct abnormal curvature in the cervical spine of a patient, the cervical traction device is used in conjunction with a therapy table having a surface on which the patient lies in a supine position during treatment, the cervical traction device comprising:

a traction assembly configured to cyclically apply a traction force to the cervical spine at an angle to the longitudinal axis of the cervical spine to bend the cervical spine, the traction assembly comprises an electric motor operably connected to a headgear by a traction line, the traction line is capable of transferring traction force generated by the electric motor to the headgear, the electric motor is operably connected to the traction line by a linkage and a linear actuator rod, together the linkage and the linear actuator rod are configured to convert torque generated by the electric motor into back-and-forth linear motion used to cyclically apply traction force to the traction line and thereby the headgear, the linear actuator rod is supported by two posts, each of the two posts includes an eyelet through which the linear actuator rod reciprocates; and a curved orthosis adapted to rest directly on the surface of the therapy table and for being positioned under the cervical spine of the patient during treatment;

wherein the traction assembly is configured to bend the cervical spine about the curved orthosis while exerting the traction force.

2. The cervical traction device of claim 1, wherein the headgear is pulled rearwardly and downwardly, relative to the longitudinal axis of the cervical spine, by the traction line.

3. The cervical traction device of claim 2, wherein the traction line includes a spring, the spring is adapted to graduate traction force being applied to the cervical spine of the patient by the headgear.

4. A cervical traction device used to correct abnormal curvature in the cervical spine of a patient, the cervical traction device is used in conjunction with a therapy table having a surface on which the patient lies in a supine position during treatment, the cervical traction device comprising:

a traction assembly configured to cyclically apply a traction force to the cervical spine at an angle to the longitudinal axis of the cervical spine to bend the cervical spine;

a frame configured to support the traction assembly, the frame includes a generally I-shaped base having a fore-and-aft extending longitudinal member and a pair of transversely extending cross members at opposite ends thereof, the frame also includes an upright mast; and a curved orthosis adapted to rest directly on the surface of the therapy table and for being positioned under the cervical spine;

wherein the traction assembly includes an electric motor operably connected to a headgear by a traction line, the traction line is capable of transferring traction force generated by the electric motor to the headgear, the electric motor is operably connected to the traction line by a linkage and a linear actuator rod, together the linkage and the linear actuator rod are configured to convert torque generated by the electric motor into back-and-forth linear motion used to cyclically apply traction force to the traction line and thereby the headgear, the linear actuator rod is supported by two posts, each of the two posts includes an eyelet through which the linear actuator rod reciprocates, the traction assembly also includes a first pulley device connected to the upright mast of the frame, the two posts supporting the linear actuator rod are positioned between the electric motor and the first pulley device;

wherein the traction assembly is configured to bend the cervical spine about the curved orthosis while exerting the traction force;

wherein the curved orthosis is positioned on the therapy table so that a longitudinal axis of the curved orthosis is generally parallel to the transversely extending cross members of the frame.

5. The cervical traction device of claim 4, wherein the traction assembly also includes a second pulley device connected to the upright mast of the frame, the traction line extends through the first pulley device and is moveable relative thereto such that the traction line defines a first length between the headgear and the first pulley device, the traction line also extends through the second pulley device and is moveable relative thereto such that the traction line defines a second length between the first pulley device and the second pulley device.

6. The cervical traction device of claim 5, wherein the traction force is applied by the headgear which is pulled rearwardly and downwardly, relative to the longitudinal axis of the cervical spine, by the traction line.

7. The cervical traction device of claim 5, wherein the first pulley device can be used to hold the first length of the traction line at an angle between 0° and 45°, inclusive, from horizontal.

8. The cervical traction device of claim 5, wherein the first length of the traction line is held at an angle substantially 45° from horizontal by the first pulley device.

9. The cervical traction device of claim 5, wherein the traction line includes a spring, the spring is adapted to graduate traction force being applied to the cervical spine of the patient by the headgear.

10. The cervical traction device of claim 4, wherein the curved orthosis has a curved exterior shaped to induce and maintain cervical lordosis while traction is being applied to the cervical spine of the patient.

11. The cervical traction device of claim 10, wherein the curved orthosis has the general shape of an elliptical semi-cylinder.

12. A cervical traction device used to correct abnormal curvature in the cervical spine of a patient, the cervical traction device is used in conjunction with a therapy table having a surface on which the patient lies in a supine position during treatment, the cervical traction device comprising:

a traction assembly configured to cyclically apply a traction force to the cervical spine at an angle to the longitudinal axis of the cervical spine to bend the cervical spine;

a frame configured to support the traction assembly, the frame includes an upright mast; and a curved orthosis adapted to rest directly on the surface of the therapy table and be positioned under the cervical spine of the patient during treatment, the curved orthosis includes a curved exterior shaped to induce and maintain cervical lordosis while traction is being applied to the cervical spine of the patient;

wherein the traction assembly includes an electric motor operably connected to a headgear by a traction line, the traction line is capable of transferring traction force generated by the electric motor to the headgear, the electric motor is operably connected to the traction line by a linkage and a linear actuator rod, together the linkage and the linear actuator rod are configured to convert torque generated by the electric motor into back-and-forth linear motion used to cyclically apply traction force to the traction line and thereby the headgear, the linear actuator rod is supported by two posts positioned between the electric motor and the upright mast of the frame, each of the two posts includes an eyelet through which the linear actuator rod reciprocates;

wherein the traction assembly is configured to bend the cervical spine about the curved orthosis while exerting the traction force.

13. The cervical traction device of claim 12, wherein the headgear is pulled rearwardly and downwardly, relative to the longitudinal axis of the cervical spine, by the traction line.

14. The cervical traction device of claim 13, wherein the traction line includes a spring, the spring is adapted to graduate traction force being applied to the cervical spine of the patient by the headgear.

* * * * *